US005082061A

United States Patent [19]

Dollison

[11] Patent Number: 5,082,061

[45] Date of Patent: Jan. 21, 1992

[54] ROTARY LOCKING SYSTEM WITH METAL SEALS

[75] Inventor: William W. Dollison, Dallas, Tex.

[73] Assignee: Otis Engineering Corporation, Dallas, Tex.

[21] Appl. No.: 557,668

[22] Filed: Jul. 25, 1990

[51] Int. Cl.[5] ..... E21B 23/02

[52] U.S. Cl. ..... 166/378; 166/115; 166/217; 166/237; 166/242; 166/382; 285/391

[58] Field of Search ..... 166/115, 116, 117.7, 166/242, 237, 72, 322, 217, 378, 382, 380; 285/391, 315

[56] References Cited

U.S. PATENT DOCUMENTS

| | | | |
|---|---|---|---|
| 1,629,058 | 5/1927 | Wilson | 285/391 X |
| 1,896,104 | 2/1933 | Simmons | 166/242 X |
| 2,673,614 | 3/1954 | Miller | 166/214 |
| 2,963,101 | 12/1960 | Koppl | 285/391 X |
| 3,208,531 | 9/1965 | Tamplen | 166/125 |
| 3,216,504 | 11/1965 | Roark | 166/237 X |
| 3,442,536 | 5/1969 | Fowler | 285/391 X |
| 4,046,405 | 9/1977 | Bonds | 166/237 X |
| 4,538,685 | 9/1985 | Pringle et al. | 166/382 X |
| 4,915,175 | 4/1990 | Mashaw, Jr. | 166/115 X |
| 4,921,044 | 5/1990 | Cooksey | 166/116 |

*Primary Examiner*—Hoang C. Dang
*Attorney, Agent, or Firm*—Roland O. Cox

[57] ABSTRACT

A locking system utilizing metal seals for sealing and a rotary lock mandrel which is rotated to lock by a rotary running tool in a landing nipple in a well conduit. The lock mandrel has a metal sealing surface sealingly engageable with a metal seat in the landing nipple and orientors on a number of helically profiled segments which are rotatably engageable with mating profiled segments in the landing nipple. As the lock mandrel is lowered on the running tool into the landing nipple, lock mandrel segments are oriented between nipple segments, and the mandrel metal sealing surface engages the metal seat in the landing nipple. Downward jarring on the running tool rotates the mandrel segments into engagement with the landing nipple segments, locking the lock mandrel in the landing nipple, sealingly engaging the metal seal surface on the metal seat and releasing the running tool from the locking mandrel for retrieval from the well conduit.

15 Claims, 3 Drawing Sheets

ROTARY LOCKING SYSTEM WITH METAL SEALS

BACKGROUND (1) Technical Field

This invention pertains to locking systems useful to releasably position well flow control devices in a flow conduit in a well. The present invention particularly pertains to a lock mandrel carrying a flow control, which is oriented on lowering into a compatible landing nipple and rotated by the running tool to seal metal to metal and lock in the landing nipple.

(2) Background Information

Significant and very commercially successful prior locking systems are disclosed in U.S. Pat. Nos. 2,673,614 to Ira A. Miller and 3,208,531 to Jack W. Tamplen. In both prior systems, the running tool moves the lock mandrel downwardly into sealing and locking engagement with a compatible landing nipple in a well flow conduit. Both prior systems utilized resilient material for sealing which often deteriorates rapidly in high temperature and pressure environments in deep well conduits.

SUMMARY OF THE INVENTION

The locking system of this invention includes a landing nipple connectible in a well conduit. The landing nipple has an internal metal seat and helically profiled segments with upper orienting surfaces. A well flow control device is connected to a rotary look mandrel, which is connected to a rotary running tool and lowered into the well conduit and landing nipple. The rotary lock mandrel has a metal sealing surface and helically profiled segments with lower orienting surfaces. As the lock mandrel moves downwardly in the landing nipple, the lock mandrel orienting surfaces engage the landing nipple orienting surfaces, orienting the lock mandrel segments to be moved downwardly between the landing nipple segments until the lock mandrel metal sealing surface engages the landing nipple metal seat. Repeated downward impact on the running tool operates the running tool to rotate the rotary lock mandrel and segments into locking engagement with the landing nipple segments, sealingly engaging the lock mandrel metal seal surface with the landing nipple metal seat and disconnecting the running tool from the lock mandrel. The lock mandrel may be unlocked for retrieval from the landing nipple by engaging and moving a releasably positioned support holding the lock mandrel segments in expanded position to a position permitting the segments to be moved to a retracted position.

A principal object of this invention is to provide a locking system wherein the landing nipple and lock mandrel have metal seals and the lock mandrel is rotated by the running tool into sealed and locked engagement with the landing nipple and the lock mandrel may be unlocked from the landing nipple by upward pull.

An object of this invention is to provide a rotary lock mandrel having helically profiled segments with orienting surfaces which engage orienting surfaces on helically profiled segments in a compatible landing nipple and orient the lock mandrel segments to move down between the segments in the landing nipple to a position for rotation into locking engagement with the landing nipple.

An object of this invention is to provide a rotary locking mandrel which provides for transmission of the downward force resulting from rotating the lock mandrel to lock in the landing nipple to sealingly engage the lock mandrel in the landing nipple.

Another object of this invention is to provide a rotary lock mandrel having a lower body with a metal seal surface which is swivelably connected to the lock mandrel.

Also an object of this invention is to provide a rotary running tool, which is operated by jar impact after connection to a rotary lock mandrel to rotate the lock mandrel into sealing and locking engagement in a compatible landing nipple and release from the lock mandrel.

BEST MODE FOR CARRYING OUT THE INVENTION

Figure 1:
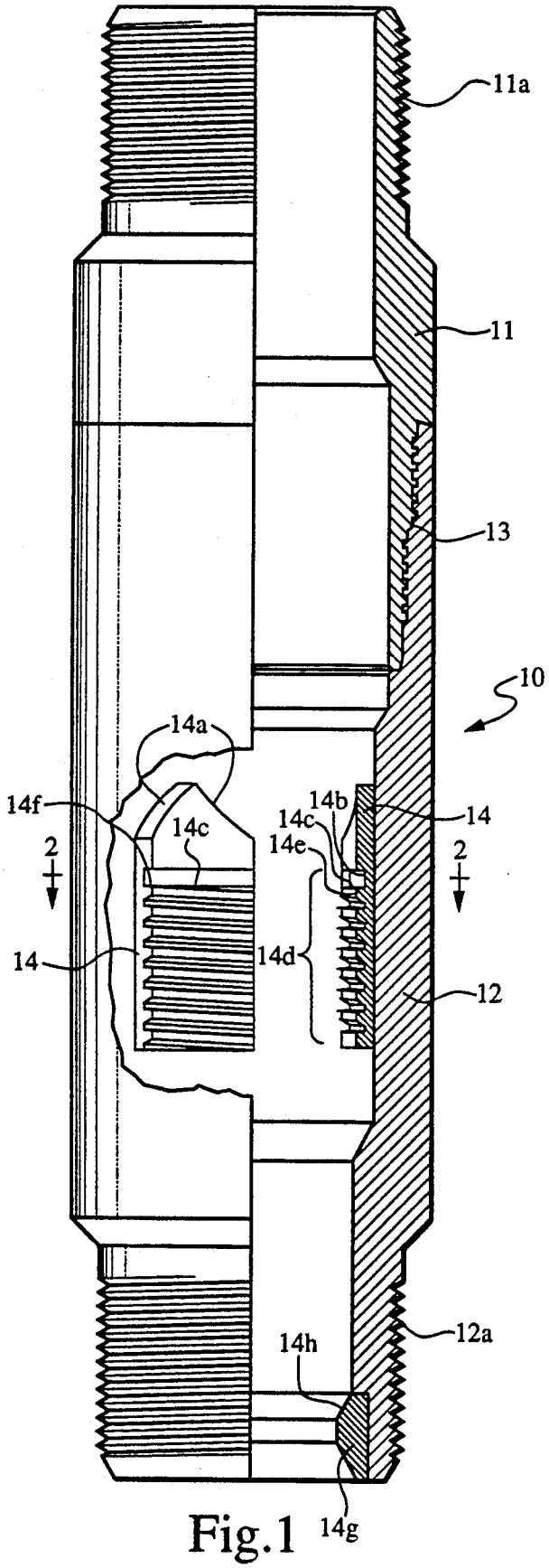
FIG. 1 is a sectioned drawing in elevation showing the landing nipple useful in the system of this invention.
Figure 2:
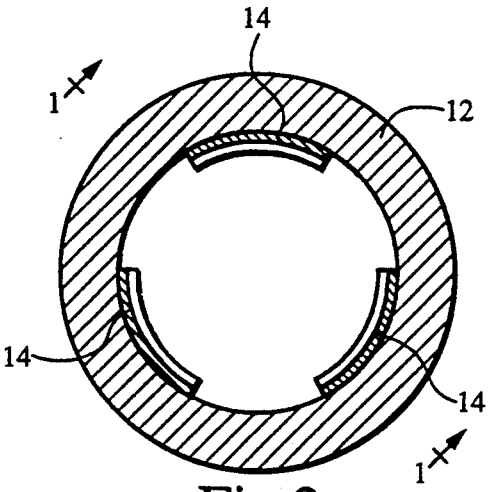
FIG. 2 is a cross sectional drawing along cutting plane line 2—2 of FIG. 1, showing the arrangement of segments in the landing nipple.

FIG. 1 shows a landing nipple 10 having an upper body 11 and a lower body 12 which are connected together with a sealing thread 13. The upper and lower bodies have means **11*a* and 12*a* for connection into a well flow conduit. A number of helically profiled segments 14 are positioned as shown 120° apart in lower body 12 (see also FIG. 2). A thread profile is shown on each segment, but any helical profile could be used. Each segment is 60° wide and has camming surfaces 14*a*, a groove 14*b*, which has a lower side 14*c* and a helically profiled section 14*d*, which has a bore 14*e*. The lower groove sides 14*c* are in the same horizontal plane. On each segment, the same helix and same profile is cut starting from the point of intersection 14*f* (for a right hand helix) of the lower groove side 14*c* and the bore 14*d* at the edge of each segment. An insert 14*g* having a sealing surface 14h is connected in the lower end of lower body 12** by welding or brazing.

Figure 3:
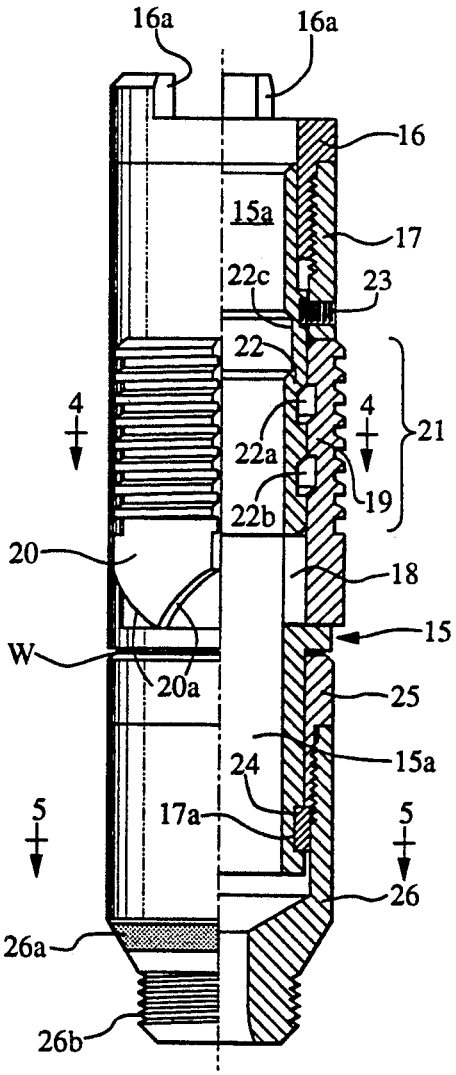
FIG. 3 is a sectioned drawing in elevation showing the rotary lock mandrel utilized in the invention system.

FIG. 3 shows a rotary lock mandrel 15 having a longitudinal flow passage 15a and a half clutch driven member 16 on its upper end. The driven member is connected in segment mandrel 17, which has a number of window like openings 18. Mounted on each opening is a radially moveable circular segment 19 having an orientor 20 with camming surfaces 20a and a helically profiled section 21. The upper ends of circular segments 19 are in the same horizontal plane and the same helix and same profile is cut on each profiled section 21 so as to rotatively engage the segments 14 of landing nipple 12 when the upper ends of segments 19 are positioned in the same horizontal plane with the lower side 14c of grooves 14b in landing nipple segments 14.

Figure 4:
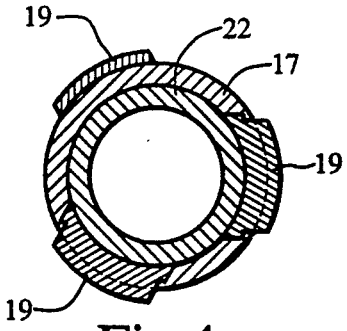
FIG. 4 is a drawing in cross section of the lock mandrel, along line 4—4 of FIG. 3, through the lock mandrel segments and support.

Slidably mounted in mandrel 17 is a support 22 which is releasably positioned in the mandrel by shearable member 23 while holding segments 19 in the expanded position—see also FIG. 4. The support has external recesses 22a and 22b and an internal groove 22c.

Figure 5:
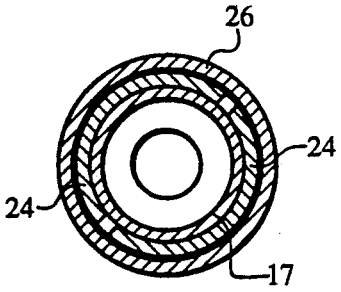
FIG. 5 shows a cross sectional view of the lock mandrel, along line 5—5 of FIG. 3, through the swivel connection in the lock mandrel.

A groove 17a around lower mandrel 17 houses a split ring 24 which swivelably connects a body connector 25 on the key mandrel—see also FIG. 5. Captured between a shoulder on the mandrel and the upper end of the body connector is a belleville spring washer W which is useful to transmit downward force from the key mandrel to connector 25 and into body 26 connected to 25. Body 26 has metal sealing surface 26a and a connection 26b for attachment of a well flow control.

Figure 6:
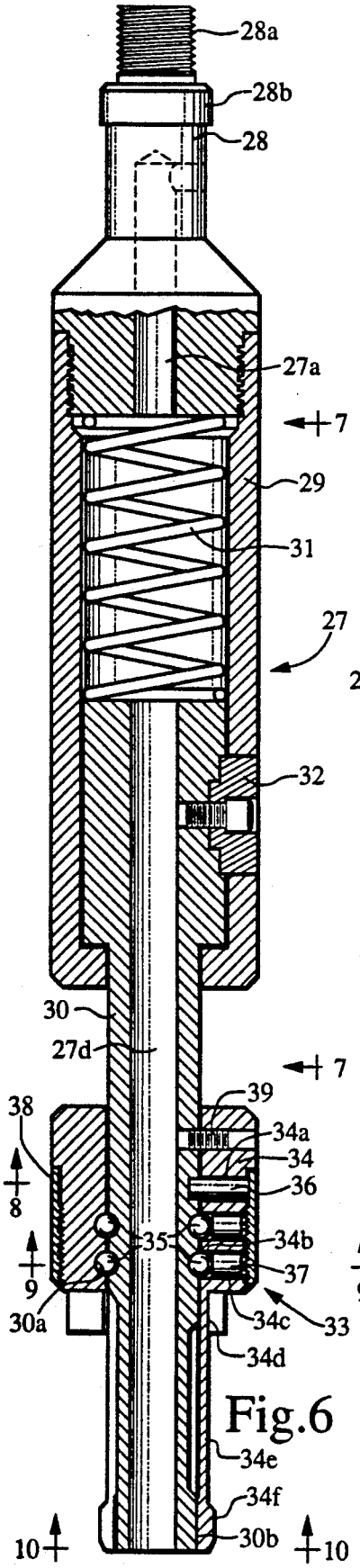
FIG. 6 is an almost completely sectioned drawing in elevation of the rotary running tool useful in the invention system.
Figure 7:
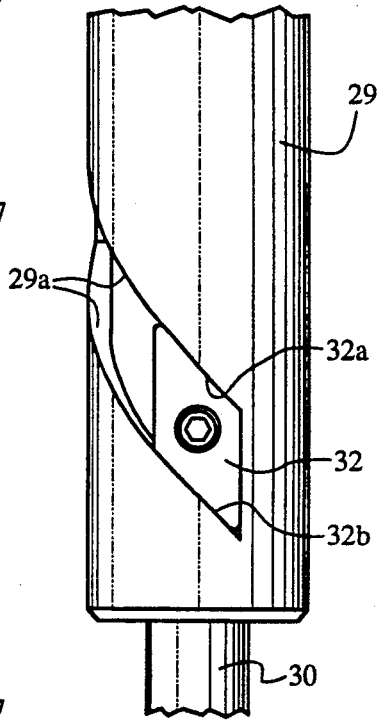
FIG. 7 is an elevational view from line 7—7 of a portion of the rotary running tool of FIG. 6.

The rotary running tool 27 of FIG. 6 has a through flow passage 27a and connector 28 connected to a housing 29. The connector has a connection 28a for connecting tool 27 to a well servicing tool string and a fishing flange 28b. Slidably mounted in the housing is an anvil 30 and a spring 31 biasing the anvil downwardly. As shown in FIG. 7, a helical slot 29a has been cut in the housing and a lug 32, with camming surfaces 32a and 32b, has been slidably mounted in the slot and connected to the anvil.

Figure 8:
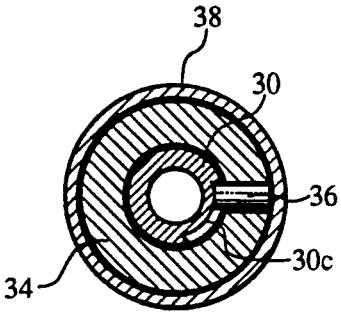
FIG. 8 is a drawing of a cross section along line 8—8 of FIG. 6 showing the pin which limits rotation of the anvil in the running tool connector.
Figure 10:
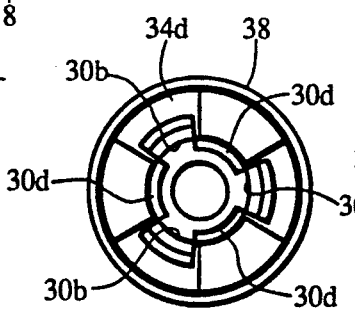
FIG. 10 is a view along line 10—10 of the lower end of the running tool of FIG. 6 with the anvil in lugs expanded position.

Mounted around and cooperable with the lower anvil is a rotary connector assembly 33, useful to connect running tool 27 to rotary look mandrel 15. The lower anvil has been provided with at least one groove around 30a, which is semi-circular in cross-section and a number of support surfaces 30b also shown in FIGS. 10 and 11. A slot 30c (see FIG. 8) is provided around the anvil and grooves 30d are provided between support surfaces 30b (FIGS. 10 and 11) into which lugs 34f may be retracted.

Connector assembly 33 includes a collet 34 having a hole 34a, at least one internal groove 34b, which is semi-circular in cross-section, a lower hole 34c, a half clutch driving member 34d with a number of slots and a number of fingers 34e, each finger having a lug 34f, which is engageable with an anvil support surface 30b.

Figure 9:
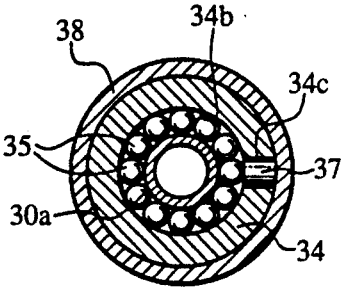
FIG. 9 is a cross sectional drawing taken along line 9—9 of FIG. 6 showing the rotational connection between the running tool anvil and connector.

To position the collet for limited rotation around and connect it on the anvil, a number of balls 35 have been introduced through collet hole 34c into grooves 30a and 34b—see also FIG. 9. A pin 36 has been installed in hole 34a and extends into anvil slot 30c. Slot 30c limits rotation of the pin and collet to 60° around the anvil between lugs expanded position where lugs 34f engage support surfaces 30b and lugs retractable position where surfaces 30b are between lugs 34f. Pin 36 and a plug 37 in hole 34c are retained by a cover 38 connected on the collet. A shearable member 39 threaded through the collet into a hole in the anvil, releasably positions anvil support surfaces 30b under lugs 34f, holding the lugs in expanded position.

To utilize the rotary lock system of this invention, a flow control device to be installed in landing nipple 10 in a well flow conduit is connected on rotary lock mandrel 15. Rotary running tool 27 is connected on a string of well serving tools which include a jar and in the lock mandrel support groove 22c by removing shearable member 39, turning collet 34 on anvil 30 to position support surfaces 30b between lugs 34f and inserting the running tool collet into passage 15a in rotary lock mandrel 15. After running tool driving member 34d engages driven member 16 and collet lugs 34f expand into support groove 22c, connector assembly 33 is rotated on anvil 30 positioning surfaces 30b under lugs 34f to hold the lugs expanded in the support groove connecting the rotary running tool to the rotary lock mandrel.

The running tool and lock mandrel are now lowered into the well conduit and on entry into the landing nipple, lock mandrel orientor camming surfaces 20a engage landing nipple segment camming surfaces 14a and turn the lock mandrel so the lock mandrel segments 19 can be moved down between landing nipple segments 14 until metal seal surface 26a on lock mandrel body 26 engages landing nipple metal sealing surface 14h. Unflexed washer W positions segments 19 to be rotated into engagement with segments 14.

Now application of downward jar impact on rotary running tool 27 moves housing 29 downwardly on anvil 30, compressing spring 31, engaging helical slot 29a with lug camming surface 32a and applying torque to the anvil. Repeated application of downward impact on the running tool rotates the lock mandrel segments 19 into engagement with landing nipple segments 14 through running tool driving member 34d and lock mandrel driven member 16. As segments 19 are rotated into segments 14, downward force acting on the segment mandrel 17 is transmitted through flexed washer W, connector 25 and into body 26 to sealingly engage metal sealing surface 26a with landing nipple sealing surface 14h on insert 14g. When the lock mandrel is rotated to engage the landing nipple, metal sealing surface 26a does not rotate on sealing surface 14h as body 26 may rotate on segment mandrel 17. Lock mandrel 15 is now locked in sealing engagement in landing nipple 10 with support 22 positioning segments 19 in expanded position.

Figure 11:
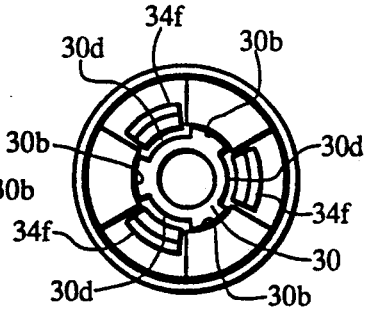
FIG. 11 is also a view along line 10—10 of the lower end of the running tool of FIG. 6 showing the anvil rotated to lugs retractable position.
Figure 12:
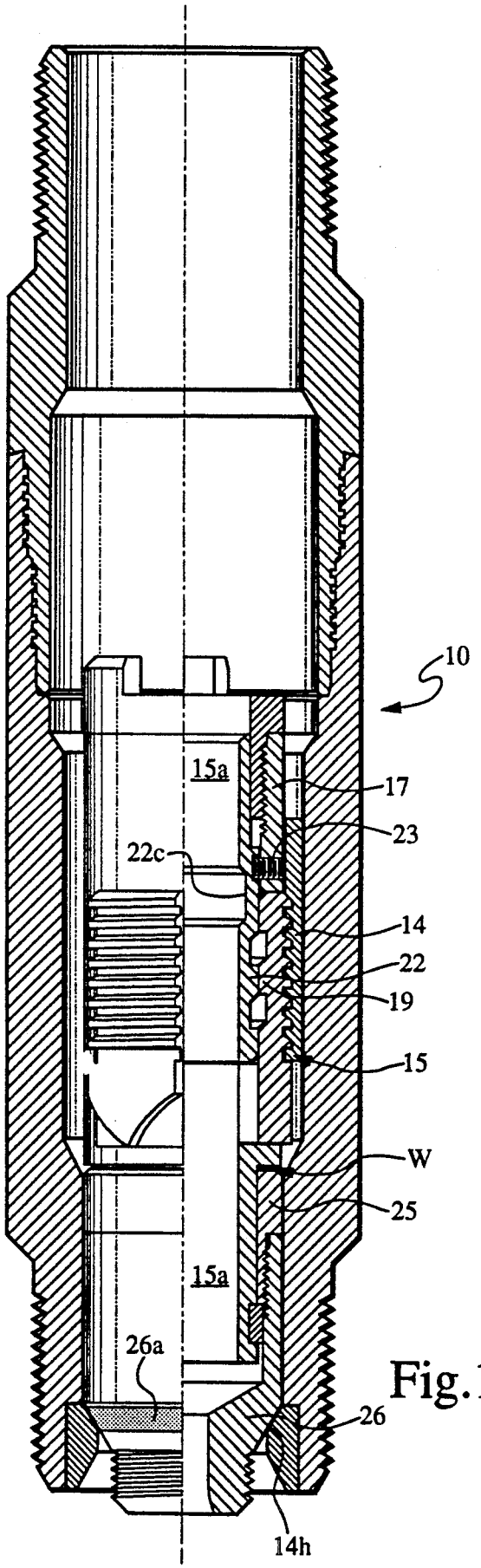
FIG. 12 is a partially sectioned drawing in elevation showing the rotary lock mandrel sealingly engaged and locked in the landing nipple of the present invention.

Continued downward impact on the running tool will eventually shear member 39 and rotate the anvil 60° positioning anvil grooves 30d under lugs 34f as shown in FIG. 11. Raising running tool 27 will retract lugs 34f into grooves 30d and from support groove 22c, permitting the running tool to be retrieved from the well conduit back to surface. Two-way flow may now occur through the flow control and mandrel flow passage 15a (see FIG. 12).

When it is desirable to retrieve the flow control and lock mandrel 15 from landing nipple 10, a conventional pulling tool is connected to well servicing tools including a jar, lowered into the well conduit and the pulling tool is operated to connect into groove 22c in the lock mandrel support. Upward impact forces delivered to the pulling tool by the jar will shear lock mandrel shearable member 23 and move support 22 upwardly until the mandrel segments 19 are cammed into support recesses 22a and 22b and into retracted position. The lock mandrel and flow control may now be retrieved from the landing nipple and flow conduit.

I claim:

1. A rotary locking system comprising:

(a) a rotary landing nipple connected in a conduit, said landing nipple having a metal seat therein;

(b) rotary lock mandrel means for sealing and releasably locking in said rotary landing nipple, said lock mandrel means having a metal sealing surface sealingly engageable with said landing nipple metal seat; and (c) rotary running tool means releasably connected to said rotary lock mandrel means for lowering said lock mandrel means into said landing nipple and rotating said lock mandrel means to sealingly engage and lock in said landing nipple, said running tool means automatically releasable from said lock mandrel means on application of a predetermined rotating force by said running tool means on said lock mandrel means.

2. The locking system of claim 1 wherein the landing nipple includes segments therein above said metal seat, each said segment having upper orienting camming surfaces and a helical profile.

3. The locking system of claim 2 wherein the lock mandrel means includes helically profiled segments, said profiled segments rotatable into releasably locked engagement with the landing nipple profiled segments to lock said locking mandrel means in said landing nipple.

4. The locking system of claim 3 wherein the lock mandrel profiled segments have orienting camming surfaces thereon engageable and cooperable with the landing nipple segment camming surfaces for orienting the lock mandrel means for rotation to lockingly and sealingly engage said landing nipple.

5. The locking system of claim 4 wherein the lock mandrel means further includes a lower body swivelably connected to the upper mandrel with force transmitting means therebetween and each locking mandrel segment and landing nipple segment has mating helical profiles so that lockingly engageable rotation of said locking mandrel means in the landing nipple transmits a downward force from said upper mandrel through said force transmitting means into said lower body to sealingly engage the locking means metal sealing surface with the landing nipple metal seat.

6. A rotary lock mandrel rotatable into releasably locked engagement with a compatible landing nipple in a conduit, said rotary lock mandrel having a longitudinal flow passage therethrough and c mprises:

(a) an upper mandrel having openings therein;

(b) helically profiled segment means for orienting and locking said rotary locking mandrel in said landing nipple mounted for radial movement in each said opening;

(c) a support slidably mounted and releasably positioned in a first position in said mandrel expanding said profiled segment means, said support longitudinally moveable to a second position permitting said profiled segment means to be moved to a retracted position;

(d) a lower body having a metal sealing surface thereon;

(e) means swivelably connecting said lower body to said mandrel; and (f) force transmitting means between said mandrel and said body.

7. The rotary lock mandrel of claim 6 wherein the profiled segment means include a profiled section thereon with orienting camming surfaces below said profiled section.

8. The rotary lock mandrel of claim 7 wherein the profiled section has a helical profile.

9. The rotary lock mandrel of claim 6 wherein the means swivelably connecting the body to the mandrel comprises:

(a) a groove around the mandrel;

(b) a shoulder in the body; and (c) a split ring in said mandrel groove below said body shoulder.

10. The lock mandrel of claim 6 wherein the force transmitting means is a belleville spring washer.

11. A rotary locking system comprising:

(a) a rotary landing nipple connected in a conduit, said landing nipple having profiled segments and a seating surface therein;

(b) rotary lock mandrel means for sealing and releasably locking in said landing nipple, said lock mandrel means having:

a sealing surface sealingly engageable with said landing nipple seating surface and a segment mandrel with openings therethrough, a radially moveable profiled segment mounted in each said opening, said segments rotatively engageable with said landing nipple profiled segments for releasably locking said rotary lock mandrel in said rotary landing nipple, a support mounted for longitudinal movement in said segment mandrel for holding said lock mandrel profiled segments releasably locked in said landing nipple segments, said support having an internal groove; and (c) a rotary running tool connectible to said lock mandrel means for lowering said lock mandrel means into and rotating said lock mandrel means to engage said lock mandrel segments with said landing nipple segments and to sealingly engage said lock mandrel sealing surface with said landing nipple seat, said running tool including:

a housing, an anvil mounted for rotation within said housing, means in said housing for rotating said anvil and means on said anvil for connecting said anvil into said lock mandrel support groove, said connecting means automatically releasing said anvil from said support groove and said lock mandrel on application of a predetermined rotating force by said running tool rotating means on said anvil.

12. The rotary locking system of claim 11 wherein the rotary lock mandrel segments and rotary landing nipple segments have orienting camming surfaces thereon, said camming surfaces engageable for orienting said lock mandrel to be rotatively sealed and locked in the rotary landing nipple.

13. A method of sealably and releasably locking a rotary lock mandrel in a compatible rotary landing nipple with a rotary running tool comprising the steps of:

(a) installing said rotary landing nipple in a well conduit, (b) lowering said conduit to the desired level in a well;

(c) releasably connecting said rotary lock mandrel to said rotary running tool on the surface, said running tool having a shear pin holding said running tool connected to said lock mandrel;

(d) lowering said connected rotary running tool and said rotary lock mandrel into said well conduit to engage said rotary landing nipple;

(e) further lowering of said lock mandrel into said landing nipple orienting said lock mandrel for sealing and locking rotation in said landing nipple;

(f) applying predetermined downward impact forces to said running tool to rotate said lock mandrel into sealing and locked engagement with said landing nipple and to shear said running tool pin, releasing said running tool from said lock mandrel; and (g) retrieving said running tool back to surface.

14. The method of claim 13 wherein rotating the rotary lock mandrel engages helical segments on said lock mandrel with helical segments in the rotary landing nipple and rotates said lock mandrel segments into locked engagement with said landing nipple segments.

15. The method of claim 13 wherein rotating the rotary lock mandrel sealingly engages a metal seal surface on said lock mandrel with a metal seat in the rotary landing nipple.

* * * * *